US005913371A

United States Patent [19]

Jenne

[11] Patent Number: 5,913,371

[45] Date of Patent: Jun. 22, 1999

[54] APPARATUS FOR CONTROLLING THE FEED DRIVE OF A BORING MECHANISM FOR MAKING EARTH BORES

[75] Inventor: Dietmar Jenne, Strengelbach, Switzerland

[73] Assignee: Terra AG fuer Tiefbautechnik, Strengelbach, Switzerland

[21] Appl. No.: 08/844,752

[22] Filed: Apr. 21, 1997

[30] Foreign Application Priority Data

Mar. 5, 1997 [DE] Germany ..... 197 08 997

[51] Int. Cl.[6] ..... E21B 3/06; E21B 44/00; B23Q 5/00

[52] U.S. Cl. ..... 175/27; 175/24; 173/4; 173/177

[58] Field of Search ..... 173/4, 5, 176, 173/177, 179, 181; 175/24, 27

[56] References Cited

U.S. PATENT DOCUMENTS

| | | | |
|---|---|---|---|
| 4,023,626 | 5/1977 | Salmi et al. | 173/8 |
| 4,079,795 | 3/1978 | Sackmann et al. | 175/24 |
| 4,660,656 | 4/1987 | Warren et al. | 175/26 |
| 4,938,109 | 7/1990 | Torres et al. | 81/467 |
| 5,353,882 | 10/1994 | Inoue et al. | 173/176 |
| 5,358,058 | 10/1994 | Edlund et al. | 175/24 |
| 5,465,798 | 11/1995 | Edlund et al. | 175/24 |
| 5,563,482 | 10/1996 | Shaw et al. | 318/272 |
| 5,637,968 | 6/1997 | Kainec et al. | 318/432 |
| 5,771,981 | 6/1998 | Briggs et al. | 173/4 |

*Primary Examiner*—Terry Lee Melius
*Assistant Examiner*—Gary S. Hartmann
*Attorney, Agent, or Firm*—McCormick, Paulding & Huber

[57] ABSTRACT

In a preferably hydraulic control for a preferably hydraulically-driven earth boring mechanism, whereby a boring rod equipped with a boring tool is fed into and out of the earth with simultaneous rotation, the feed speed of the rod is regulated automatically in dependence on the rotational movement applied to the boring rod and/or on the feed force applied to the boring rod to optimize the speed of the boring process and to prevent overload damage to the boring rod, boring tool and other parts of the boring mechanism.

3 Claims, 1 Drawing Sheet

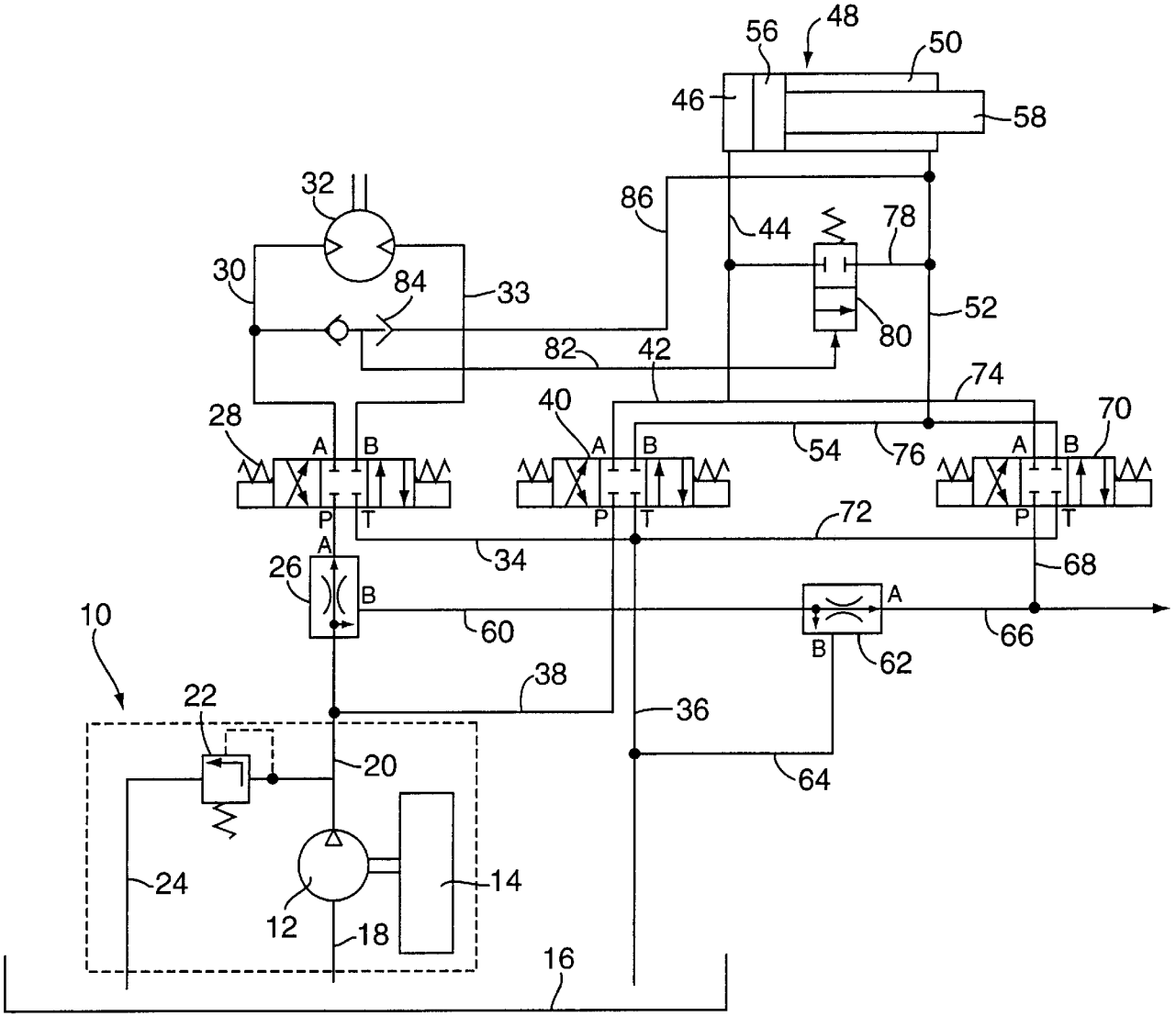
10
12
14
16
18
20
22
24
26
28
30
32
33
34
36
38
40
42
44
46
48
50
52
54
56
58
60
62
64
66
68
70
72
74
76
78
80
82
84
86
A
B
P
T

APPARATUS FOR CONTROLLING THE FEED DRIVE OF A BORING MECHANISM FOR MAKING EARTH BORES

FIELD OF THE INVENTION

The invention concerns a method for controlling the feed drive of an earth bore creating boring mechanism by means of which a boring rod carrying a boring tool is fed into the earth with simultaneous rotation.

BACKGROUND OF THE INVENTION

A problem in the operation of controllable boring mechanisms exists in having the feed speed and the rotational moment applied to the boring rod so related to one another that the boring process can be carried out as quickly as possible without the boring mechanism and above all the boring rod and the boring tool being overloaded. The latter difficulty can often appear if the earth region suddenly changes, especially if one moves from a soft to a hard earth region.

The boring mechanism is usually controlled by a human operator through two levers. With one lever the operator controls the feed speed, and with the other lever the rotational speed of the boring rod and of the boring tool arranged on the end of the boring rod. For monitoring the effective feed force and the effective rotational moment, pressure gauges stand available for use by the operator, which pressure gauges indicate the momentary effective pressure in the hydraulic circuit of the hydraulic drive for the feed and for the rotation of the boring rod. If the indicated values are too low, the operator can increase the feed speed and/or the rotational moment. If the indicated values exceed critical values, the operator must immediately lower the feed speed and/or the rotational moment. If this doesn't happen or doesn't happen fast enough, because for example, the boring head encountering a layer of stone or rock, there exists the danger of breaking the rod. The expensive work tool and the rod therefore remain in the earth. The boring must be repeated, and this leads to considerable additional cost.

It is already known to provide an overload inhibiting mechanism whereby limit values for the maximum feed force and the maximum rotational moment can be pre-set. As soon as the limit values are exceeded, the feed speed and the driving rotational moment are lowered. An exceeding of the limiting values is thereby automatically avoided. Such an overload inhibiting mechanism can, therefore, prevent a damaging of the boring mechanism, of the boring rod, and of the boring work tool during a boring procedure. They do not permit, however, an optimization of the boring process, that is, to drive the boring mechanism with the highest possible speed while avoiding an overload.

SUMMARY OF THE INVENTION

The invention has as its object, the provision of a method of the aforementioned type by means of which the advancement of earth bores, especially the creation of pilot bores with subsequent widening of the bore holes for the drawing in of pipes, can be optimized in the above described way.

For the solution of this object, the invention proposes that in a method of the aforementioned type the feed speed of the feed drive is regulated in dependence on the rotational moment applied to the boring rod.

The invention rests on the recognition that, in earth boring of the typical type, the feed speed and the rotational moment are dependent on one another. During the pilot boring and during the widening, the feed speed must be so adjusted that a highest possible constant rotational moment is effected without exceeding a limiting value of the rotational moment. If the feed speed is increased during the pilot boring, or during the widening and the drawing in of the pipe, the rotational moment also increases in almost all types of subsoil.

Preferably a desired value for the rotational moment is pre-set and the feed speed is so regulated that the difference between the desired value and the actual value of the rotational moment is smaller than a pre-given value. If the subsoil during the pilot boring, or during the widening, becomes softer typically with constant feed speed, the rotational moment decreases. In accordance with the invention however the feed speed is increased to the point at which the previously set maximum rotational moment, that is the desired value, is again reached. If on the other hand, the subsoil becomes harder or more solid, typically the rotational moment increases. With constant feed speed, this would cause the previously set maximum rotational moment to be exceeded. In accordance with the invention however, in this case the feed speed is reduced until the actual value of the rotational moment again corresponds to the pre-set maximum rotational moment. That is the desired value is at least closely approximated.

Preferably the feed speed is additionally regulated in dependence on the feed force. This solution involves a possible exceptional situation calculation in which the above rotational moment dependent feed control is not necessarily carried out in order to avoid damage to the boring rod or to the boring tool. This can happen if during pilot boring the work is done with a pointed boring head which encounters a massive rock or concrete wall. Thereupon, in that the boring head first encounters the hard obstruction with its point, the rotational moment cannot be increased quick enough, since the effective lever arm of the rotational resistance is very small. In this case, the determined but not realized feed speed corresponding to the feed force is large, and there exists the danger that the boring rod may buckle.

As with the rotational moment, therefore, it is practical to provide a limit value for the feed force and to reduce the feed speed if the feed force reaches or exceeds the limit value.

The control of the feed speed in dependence on the rotational moment and/or the feed force can take place in different ways, for example, electronically. According to a preferred embodiment indeed in a mechanism in which the boring rod is turned and fed forwardly by an hydraulic drive, the control is carried out hydraulically. This can take place, for example, in that the amount of pressure medium suplied for the feed drive is regulated in dependence on the pressure appearing in the pressure line for the rotational drive or for the feed drive. The hydraulic control has the advantage that the control time is shortest and that it functions reliably under rough operating conditions during work in deep constructions. Electronic controls in construction machines are in comparison highly subject to disturbance failures.

The invention concerns further an apparatus for controlling the hydraulic feed drive of a boring mechanism for creating earth bores whereby a boring rod carrying a boring tool is fed into the earth with simultaneous rotation by an hydraulic rotational drive. For carrying out the previously described method, an apparatus according to the invention is proposed in that the amount of the feed drive pressure medium delivered through a control valve whose control input is so coupled with the rotational drive that at the control input a control valve appears which is proportional to the rotation moment applied by the rotational drive.

In one very simple and robust embodiment which makes possible a fast response of the control, the control valve is a pressure control valve whose control input is connected with the pressure side of the rotational drive. An increase in the rotational moment leads directly to a pressure increase on the pressure side of the rotational drive and thereby with almost no hesitation to a signal at the control input of the control valve which then reduces the amount of pressure medium flowing to the feed drive.

For limiting the feed force, it is proposed in accordance with the invention that the control input of the control valve is connected through a changeover valve with the side of the feed drive and standing under pressure. In general, it is necessary only in the above described special case that the feed force be limited, if the control acting in dependence on the rotational moment does not respond or does not respond quickly enough. Through the connection of the control input of the control valve through a changeover valve to the pressure side of the feed drive, there can be achieved an additional limitation of the forward force with a low additional constructional expense.

Practically, the control valve is infinitely adjustable and is preferably arranged in a by-pass line bridging the two pressure fluid connections of the feed drive.

Further features and advantages of the invention will be apparent from the following description which in connection with the accompanying drawings explain the invention in connection with an exemplary embodiment.

BRIEF DESCRIPTION OF THE DRAWINGS

The single FIGURE of the drawing shows the hydraulic switching scheme of the hydraulic circuit of a boring mechanism for the making of earth bores and having the hydraulic elements necessary for explaining the control of the invention.

DETAILED DESCRIPTION OF THE PREFERRED EMBODIMENT

In the left lower corner of the FIGURE is seen a pressure medium source, indicated generally at 10, with a geared pump 12, which pump is driven by a motor 14 and which pump withdraws hydraulic fluid from a tank 16 through a withdrawal line 18 and supplies it to a pressure line 20. The pressure line 20 is also connected with the tank 16 by a pressure limiting valve 22 and a return flow line 24.

The pressure line 20 leads through an adjustable flow regulating valve 26 to the pressure port P of a 4/3-directional valve 28 whose port A is connected with the pressure port or side of a hydraulic motor 32 through a line 30. The other exhaust port or side of the motor 32 is connected by a line 33 with the pressure the port or side B of the 4/3-directional valve 28. The tank port T of the 4/3-directional valve 28 is connected by line sections 34 and 36 with the tank 16.

The hydraulic motor 32 serves to rotate a boring rod of a boring mechanism for the creation of earth bores, as is described, for example, in DE-A-43 05 423. In respect to details of such a boring mechanism, reference is made to said publication.

The pressure line 20 is further connected by a line 38 with the pressure port P of a directional valve 40, which is constructed as a rapid acting valve and whose port A is connected by line sections 42, 44 with the piston space 46 of an hydraulic cylinder 48. The tank port T of the directional valve 40 is connected by the line 36 with the tank 16. The piston rod sided space 50 of the hydraulic cylinder 48 is connected with the port B of the directional valve 40 by line sections 52, 54.

The hydraulic cylinder 48 serves to press the boring rod with the work tool into the earth and to pull it out of the earth. Therefore, the arrangement in the present case should be so chosen that, by a corresponding force reversal, the boring rod is pressed into the earth when the piston 56 of the hydraulic cylinder 48 is driven inwardly along with its piston rod 58, while the boring rod is pulled if the piston 56 along with its piston rod 58 is driven outwardly. In the driving in of the piston 56, the pressure port P is connected with the port B and the tank port T is connected with the port A of the directional valve 40 (left switching symbol of the valve 40). In the moving out of the piston, the port T is blocked, while both ports A and B are connected with the port P (right switch symbol of the valve 40). In this case, the hydraulic oil forced out of the piston rod space 50 is supplied back to the pressure lines 42 and 44 by the line sections 52 and 54 and the port B, so that the piston 56 can be driven more rapidly outwardly. This has the advantage that thereby the piston rod when need be can be quickly withdrawn and the time required for a change in the rod can be distinctly reduced.

The port B of the flow regulating valve 26 is connected by a line section 60 with a further flow regulating valve 62 whose port B stands in connection with the tank line 36 through a line 64. The port A of the flow regulating valve 62 stands in connection with the pressure port P of a 4/3-directional valve 70 through lines 66 and 68. The line 66 leads moreover to further consuming devices of the boring mechanism. The port T of the directional valve 70 is connected with the tank line 36 by a line 72. The port A of this directional valve is connected by a line section 74 with the line 44 leading to the piston space 46, and the port B of the directional valve 70 is connected by a line section 76 with a line 52 leading to the piston rod space 50.

As will be recognized, the hydraulic cylinder 48 can also be controlled through the directional valve 70 in which case either the amount of hydraulic medium conducted to the piston space 46 or conducted to the piston rod space 50 is adjustable through the flow regulating valves 26, 62. The flow regulating valve 62 is adjusted to a fixed maximum value which limits the maximum feed speed.

The line 44 leading to the piston space 46 and the line 52 leading to the piston rod space 50 are connected with one another by a by-pass line 78, in which is arranged an infinitely adjustable closed to open pressure switching valve 80. The control input to the valve 80 is connected by a control line 82 and a changeover valve 84 on one hand with the pressure line 30 connected to the hydraulic motor 32 and on the other hand by a line 86 with the line 52 connected to the piston rod space 50. In dependence on the pressure in the line 30 or in the line 52, the opening of the switching valve 80 can be determined and therewith the amount of hydraulic fluid which is conducted past the hydraulic cylinder 48 and directly back to the tank can also be determined, so that the amount of hydraulic fluid conducted to the hydraulic cylinder 48 and thereby the feed speed can be determined in dependence on the effective rotational moment applied to the boring rod (represented by the pressure in the line 30) or in dependence on the feed force (represented by the pressure in the lines 86, 52).

With the hydraulic circuit as so far described, a controllable boring mechanism works in the following ways:

During the boring of a straight pilot bore, the boring head having an asymmetric control surface is continually rotated by the hydraulic motor 32 and simultaneously is pushed through the earth by the feed cylinder 48. The described hydraulic control so adjusts the feed speed that the pre-set maximum rotational moment is reached and held. That means that the pressure switching valve 80 remains closed, so long as the maximum set rotational moment is not exceeded. Thereby the boring occurs at the best possible speed. At the same time, the boring work tool, the boring rod and the boring mechanism are treated conservatively. If during the boring of the pilot hole, the boring head encounters a rock or concrete wall, the pressure in the piston rod space 50 and with it the pressure in the line 52 suddenly increases. This pressure increase is transmitted through the line 86, the changeover valve 84 and the control line 82 to the control input of the pressure switching valve 80 and causes the pressure switching valve 80 to open. Thereupon hydraulic fluid flows through the by-pass line 78 so that the feed speed (inward drive speed of the piston 56) is reduced, until the pressure in the line 52 again corresponds to the set limit value of the pressure changing valve 80. This way a buckling of the boring rod is avoided. The control functions also for the case in which an obstacle is not capable of being overcome, that is the forward feed diminishes to zero. In this case, the work tool will indeed be held in its working position, but will not be damaged.

If during the boring of a pilot hole, steering is to be exercised, the boring head with its asymmetric control surface is rotated to the desired rotational position. Thereafter, the boring head is pressed into the earth without rotation. The rotational moment feed control in this case has no effect. The feed force is limited by the previously described overload prevention means, in that the feed speed is automatically reduced if a maximum set feed force corresponding to a maximum pressure in the piston rod space 50 and in the line 52 is exceeded.

After the making of a pilot bore, the boring head is unscrewed from the boring rod and replaced by a widening head. In general, the pipe to be drawn into the bore is fastened directly behind the widening head. The widening head is drawn with rotation through the earth toward the boring mechanism. In this case, only the rotational moment dependent control of the feed speed is effective as during the moving out of the piston 56 from the hydraulic cylinder 48 (corresponding to a pulling of the boring rod) the control of the feed speed in dependence on the feed force is not effective. If during this process, the resistance to the widening head should suddenly increase, which would lead to a corresponding increase of the rotary moment effective on the boring rod and therewith to an increase in the pressure in the line 30, it has the effect that through the control line 82, the pressure value set for the pressure switching valve 80 is exceeded and the pressure switching valve again opens the line 78. According to the extent of the opening, hydraulic fluid is again conducted past the hydraulic cylinder 48 and thereby the movement speed of the piston 56 is reduced until the rotational moment and with it the pressure proportional to it in the line 30 as fallen to the maximum permissible value.

The previously described control optimizes the use of a controllable boring mechanism during the making of a pilot bore as well as also during the widening of the bore and the pulling in of a pipe. Faulty human measures in the control of the boring mechanism can, therefore, be excluded. Thereby not only can damage to the boring mechanism be avoided, but also the boring mechanism can be better utilized. The essentially faster reaction time of the automatic control in comparison to the reaction time of a human operator provides the possibility for the setting of distinctly higher maximum values for the rotational moment and for the feed speed then is possible in an operation by hand.

I claim:

1. An apparatus for controlling a pressure medium actuated hydraulic feed drive (48) of a boring mechanism for creating earth bores, whereby a boring rod carrying a boring work tool is fed by the feed drive into the earth with simultaneous rotation of the boring rod by means of a hydraulic rotational drive (32) having a pressure side (30) and an exhaust side (33), wherein:

the amount of pressure medium supplied to the feed drive (48) is controllable by a control valve (80) having a control input so coupled with the rotational drive (32) that at said control input there appears a control magnitude proportional to the rotational moment applied to the boring rod by the rotational drive, said control valve (80) being a pressure control valve having said control input thereof connected with the pressure side (30) of the rotational drive (32), said hydraulic feed drive (48) having a side (50) which is pressurized during feeding of said boring tool into the earth by said feed drive, and said control input of the control valve (80) being connected through a changeover valve (84) with said side (50) of the feed drive (48) which is pressurized during feeding of said boring rod by feed drive.

2. The apparatus according to claim 1 wherein:

the control valve (80) is infinitely adjustable.

3. The apparatus according to claim 1 wherein:

the control valve (80) is arranged in a by-pass line (78) bridging the two pressure fluid sides of the feed drive (48).

* * * * *